US007156398B1

(12) United States Patent
Phillips

(10) Patent No.: US 7,156,398 B1
(45) Date of Patent: Jan. 2, 2007

(54) CARD GAME AND DECK FOR USE THEREWITH

(76) Inventor: Robert G. Phillips, 3696 E. Carmel Dr., Carmel, IN (US) 46033

( * ) Notice: Subject to any disclaimer, the term of this patent is extended or adjusted under 35 U.S.C. 154(b) by 262 days.

(21) Appl. No.: 10/910,599

(22) Filed: Aug. 3, 2004

(51) Int. Cl.
*A63F 1/00* (2006.01)

(52) U.S. Cl. ..... 273/292; 273/293

(58) Field of Classification Search ..... 273/292, 273/293

See application file for complete search history.

(56) References Cited

U.S. PATENT DOCUMENTS

| | | | | | |
|---|---|---|---|---|---|
| 45,670 | A | | 12/1864 | Kearney | |
| 82,134 | A | * | 9/1868 | Levy | 273/293 |
| 405,164 | A | * | 6/1889 | Hyatt | 273/293 |
| 516,165 | A | * | 3/1894 | Paine | 273/305 |
| 821,781 | A | | 5/1906 | Cadwallader | |
| 977,117 | A | * | 11/1910 | McPherson | 273/299 |
| 1,034,402 | A | * | 7/1912 | Hardy | 273/294 |
| 1,485,146 | A | * | 2/1924 | Mundell | 273/296 |
| 1,549,095 | A | * | 8/1925 | Levine | 273/293 |
| 1,551,761 | A | | 9/1925 | McCarroll | |
| 1,568,206 | A | | 1/1926 | Brandt | |
| 1,681,683 | A | | 8/1928 | Ramer | |
| 2,193,638 | A | * | 3/1940 | Morton | 493/344 |
| 2,901,839 | A | * | 9/1959 | Huff | 434/207 |
| D222,490 | S | * | 10/1971 | Alaska | D21/379 |
| 5,242,171 | A | * | 9/1993 | Hata | 273/292 |
| 5,441,278 | A | * | 8/1995 | Nalder | 273/296 |
| 6,098,981 | A | | 8/2000 | Schuetter | |
| 6,145,838 | A | * | 11/2000 | White | 273/295 |
| 6,149,155 | A | * | 11/2000 | Hoyt et al. | 273/292 |
| 6,874,785 | B1 | * | 4/2005 | Miller | 273/293 |
| 6,971,649 | B1 | * | 12/2005 | Richardson et al. | 273/299 |
| 2003/0090064 | A1 | * | 5/2003 | Hoyt et al. | 273/292 |
| 2005/0225032 | A1 | * | 10/2005 | Weinreb | 273/292 |

* cited by examiner

*Primary Examiner*—Eugene Kim
*Assistant Examiner*—Dolores R. Collins
(74) *Attorney, Agent, or Firm*—C. John Brannon; Bingham McHale LLP

(57) ABSTRACT

A game system including twenty-four cards, each respective card having respective top and bottom portions, each characterized by the following respective first and second suit-rank pairings: Ace of Spades and Nine of Hearts, King of Spades and Ten of Hearts . . . Nine of Spades and Ace of Hearts; Ace of Clubs and Nine of Hearts . . . Nine of Clubs and Ace of Hearts; Ace of Spades and Nine of Diamonds . . . Nine of Spades and Ace of Diamonds; Ace of Clubs and Nine of Diamonds . . . Nine of Clubs and Ace of Diamonds. A game is played by first forming two two-player teams and then equally distributing all of the cards to the players. Distribution of the cards is followed by bidding, naming a trump suit, taking tricks, accumulating points, and declaring the first team to exceed a predetermined number of points the winner.

11 Claims, 4 Drawing Sheets

CARD GAME AND DECK FOR USE THEREWITH

BACKGROUND OF THE INVENTION

It is important to learn, develop and reefing basic strategy skills, especially as relate to situational variables. As such skills are acquired and mastered, it becomes possible to formulate and test increasingly complex stratagems, such as those relating to planning and anticipating competitive gambits, revising ongoing strategies to accommodate changing variable parameters, and maximizing opportunities as they manifest themselves.

One way of acquiring and honing such skills is through the playing of educational card games that make the learning process fun and entertaining. Game systems developed toward this end include U.S. Pat. No. 821,781 to Cadwallader issued May 29, 1906; U.S. Pat. No. 977,117 to McPherson issued on Nov. 20, 1910; U.S. Pat. No. 1,034,402 to Hardy issued Jul. 30, 1912; U.S. Des. Pat. No. D45,670 to Kearney issued Apr. 28, 1914; U.S. Pat. No. 1,551,761 to McCarroll issued on May 23, 1924; U.S. Pat. No. 1,568,206 issued on Jan. 5, 1926 to Brandt; and U.S. Pat. No. 1,681,683 issued on May 4, 1927 to Ramer. However, none of these card games effectively combine the teaching of strategy involving changing variables with a readily comprehendible and entertaining rule hierarchy. Thus, there is a need for an educational card game and system for playing said game that lends itself to teaching strategies dealing with changing variables. The present invention addresses this need.

SUMMARY OF THE INVENTION

The present invention relates to a deck of twenty-four playing cards. The deck preferably includes four sets of six cards each. Each respective card includes a front face with a first portion characterized by a first suit-rank pairing and a second portion oppositely-disposed portion characterized by a second suit-rank pairing. The first set of six cards preferably includes front faces characterized by the following first and second suit rank pairings on the respective first and second portions:

the highest rank designator of a first predetermined suit and the lowest rank designator of a second predetermined suit, the second highest rank designator of a first predetermined suit and the second lowest rank designator of a second predetermined suit, the third highest rank designator of a first predetermined suit and the third lowest rank designator of a second predetermined suit, the third lowest rank designator of a first predetermined suit and the third highest rank designator of a second predetermined suit, the second lowest rank designator of a first predetermined suit and the second highest rank designator of a second predetermined suit, the lowest rank designator of a first predetermined suit and the highest rank designator of a second predetermined suit.

The second set of six cards preferably includes cards characterized by the following first and second suit rank pairings on the respective first and second portions:

the highest rank designator of a third predetermined suit and the lowest rank designator of a second predetermined suit, the second highest rank designator of a third predetermined suit and the second lowest rank designator of a second predetermined suit, the third highest rank designator of a third predetermined suit and the third lowest rank designator of a second predetermined suit, the third lowest rank designator of a third predetermined suit and the third highest rank designator of a second predetermined suit, the second lowest rank designator of a third predetermined suit and the second highest rank designator of a second predetermined suit, the lowest rank designator of a third predetermined suit and the highest rank designator of a second predetermined suit.

Likewise, the third set of six cards includes cards characterized by the following first and second suit rank pairings on the respective first and second portions:

the highest rank designator of a first predetermined suit and the lowest rank designator of a fourth predetermined suit, the second highest rank designator of a first predetermined suit and the second lowest rank designator of a fourth predetermined suit, the third highest rank designator of a first predetermined suit and the third lowest rank designator of a fourth predetermined suit, the third lowest rank designator of a first predetermined suit and the third highest rank designator of a fourth predetermined suit, the second lowest rank designator of a first predetermined suit and the second highest rank designator of a fourth predetermined suit, the lowest rank designator of a first predetermined suit and the highest rank designator of a fourth predetermined suit; and Finally, the fourth set of six cards includes cards characterized by the following first and second suit rank pairings on the respective first and second portions:

the highest rank designator of a third predetermined suit and the lowest rank designator of a fourth predetermined suit, the second highest rank designator of a third predetermined suit and the second lowest rank designator of a fourth predetermined suit, the third highest rank designator of a third predetermined suit and the third lowest rank designator of a fourth predetermined suit, the third lowest rank designator of a third predetermined suit and the third highest rank designator of a fourth predetermined suit, the second lowest rank designator of a third predetermined suit and the second highest rank designator of a fourth predetermined suit, the lowest rank designator of a third predetermined suit and the highest rank designator of a fourth predetermined suit.

The present invention further includes a method of playing a game using the above-described deck, wherein two two-player teams are formed and the six-card hands are distributed (dealt) to each player. The players sequentially bid based on the number of tricks each respective player believes his hand will enable his team to take. The status of a trump suit (including no-trump) is determined from the bidding results. The players then sequentially play their cards and tricks are taken. Points are accumulated and scores are kept. The first team to accumulate a predetermined number of points is declared the winner.

One object of the present invention is to provide an improved card deck and card game. Related objects and advantages of the present invention will be apparent from the following description.

DESCRIPTION OF THE PREFERRED EMBODIMENTS

Figure 1:
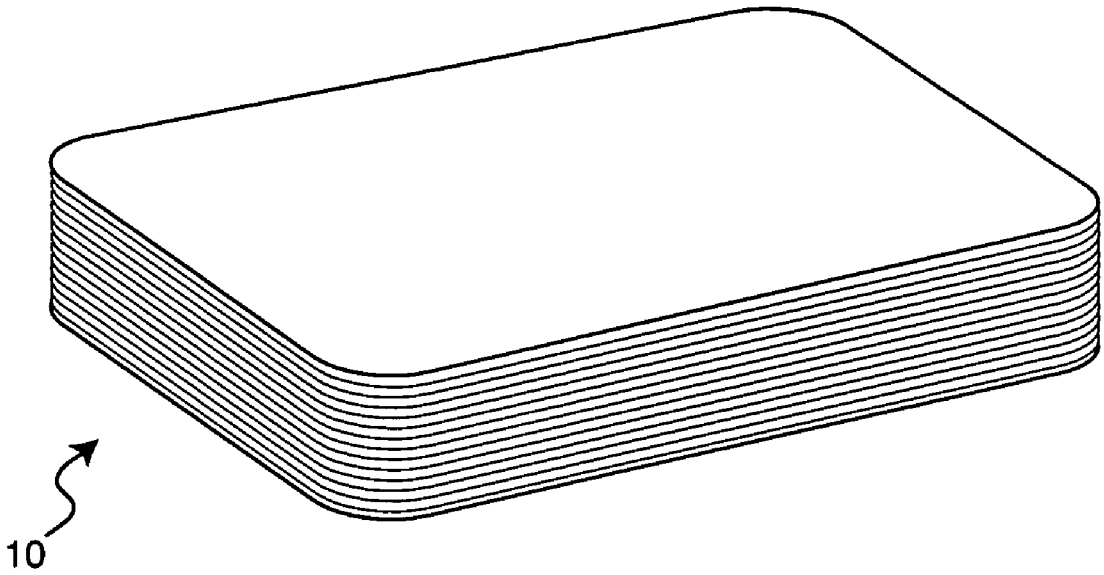
FIG. 1 is a perspective view of a first embodiment of the present invention, a deck of the twenty-four bifurcated playing cards.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
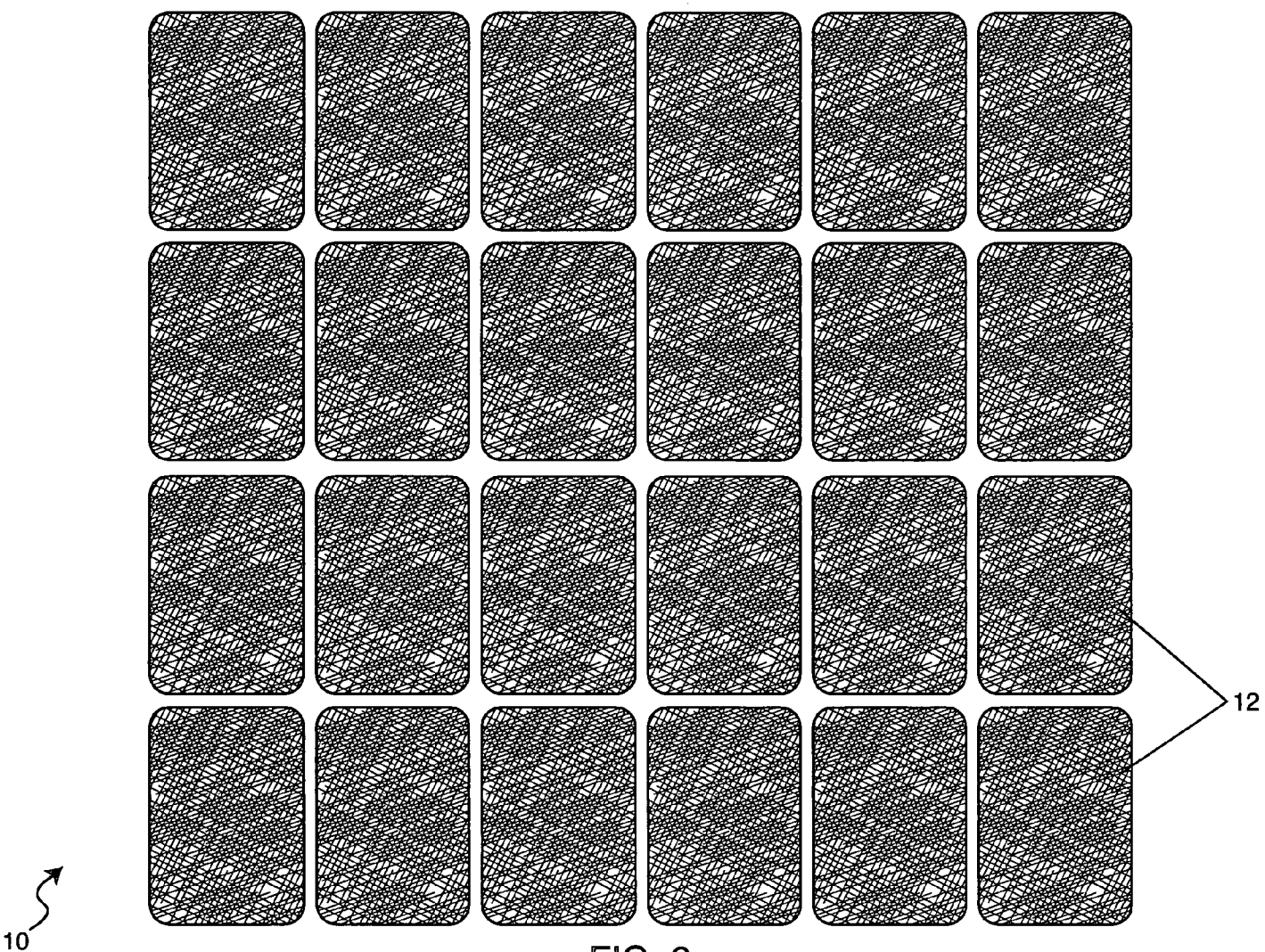
FIG. 2 is a top plan view of the cards of the deck of FIG. 1.
Figure 3A:
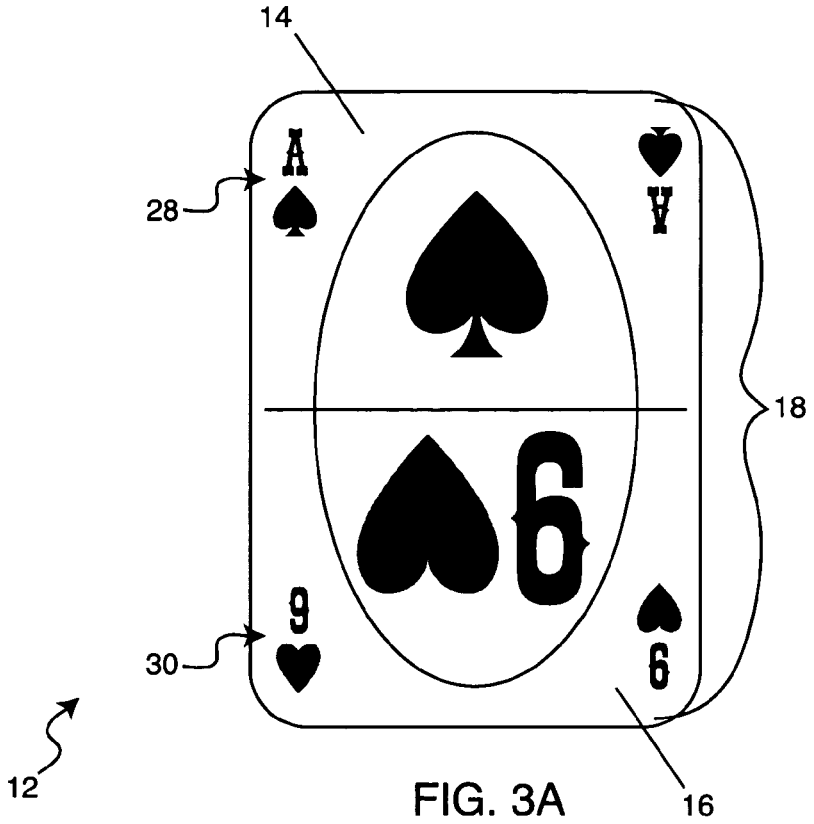
FIG. 3A is a front elevational view of a card of the deck of FIG. 1.
Figure 3B:
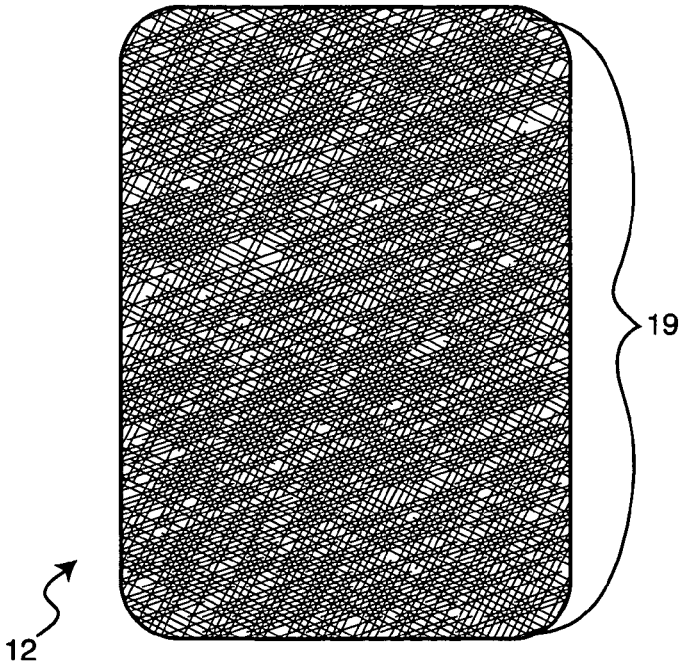
FIG. 3B is a rear elevational view of the card of FIG. 3A.
Figures 4A, 4B, 4C, 4D:
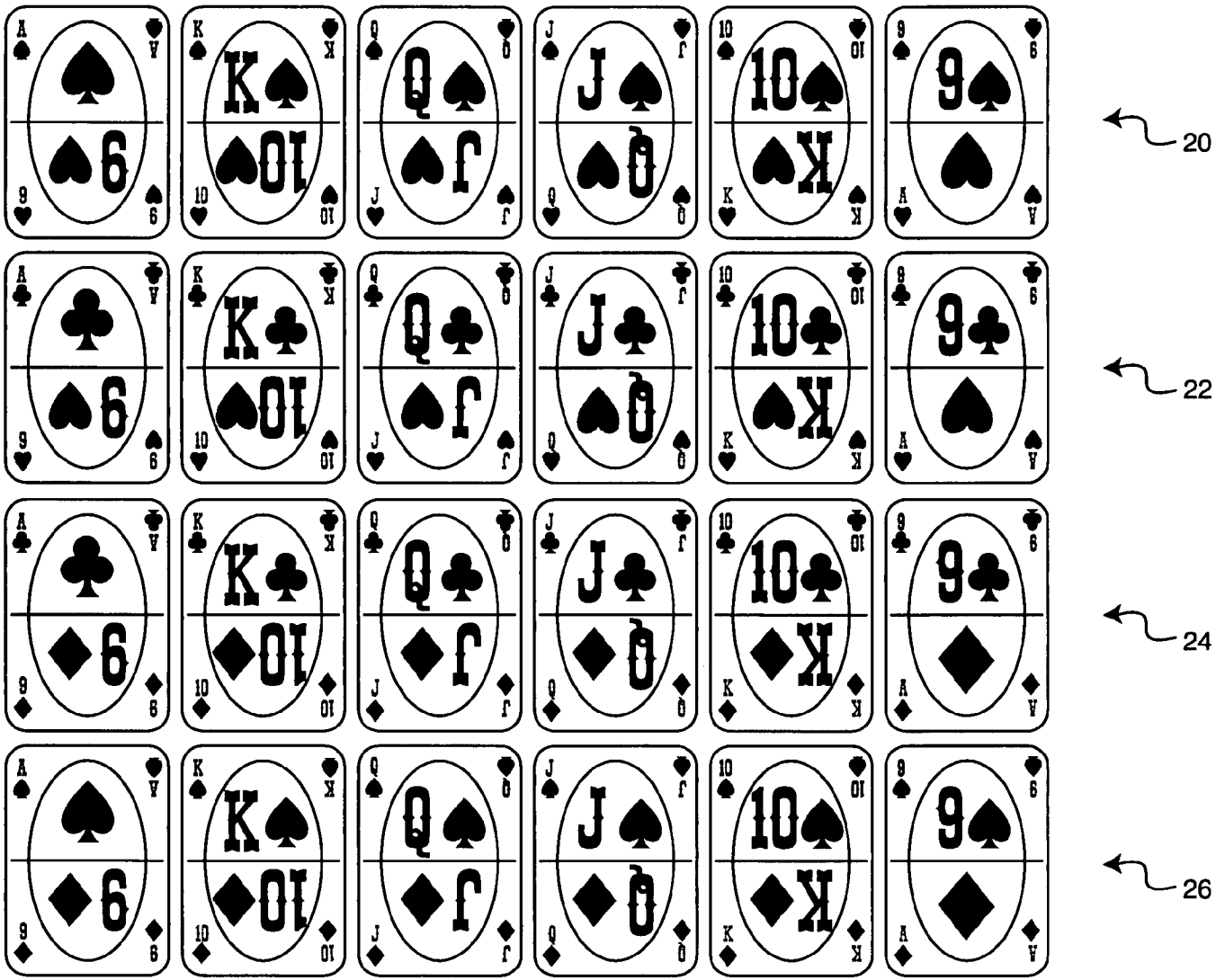
FIG. 4A is a top plan view of a first set of six cards of the deck of FIG. 1.
FIG. 4B is a top plan view of a second set of six cards of the deck of FIG. 1.
FIG. 4C is a top plan view of a third set of six cards of the deck of FIG. 1.
FIG. 4D is a top plan view of a fourth set of six cards of the deck of FIG. 1.

FIGS. 1–4D illustrate a first embodiment of the present invention. A card deck 10 is shown, preferably consisting of twenty-four playing cards 12. Each card 12 is preferably bifurcated so as to have a first face portion 14 and a second face portion 16 occupying the same front face side 18 of the card 12. The first and second portions 14, 16 are preferably equal in size, shape and area and are from time to time referred to herein for convenience as the 'top' and 'bottom' portions 14, 16, even though rotating the card 12 one-hundred and eighty (180) degrees will reverse the 'top' and 'bottom' positions. The back side 19 of each card 12 (positioned opposite the front side 18) is preferably identical to the back side 19 of every other card 12. While the above embodiment deck 10 is described as having twenty-four bifurcated cards 12, alternate embodiments may have other numbers of likewise bifurcated cards, such as, for example, fifty-two cards.

The first and second portions 14, 16 of each respective card 12 are preferably marked with respective suit and alphanumeric rank designations as are commonly found in a pinochle deck (i.e., 9, 10, Jack, Queen, King and Ace in the suits of Spades, Diamonds, Hearts and Clubs). It should be noted that while traditional suits are used in the exemplary preferred embodiment, the invention is not limited to the above-mentioned suits and any other convenient, non-traditional combination of suit designations may be selected.

Preferably, the deck 10 includes four six-card series 20, 22, 24, 26. Each respective series 20, 22, 24, 26 includes six cards 12, each respective card 12 having a first suit-rank pairing 28 appearing on the first portion 14 and a second, different suit-rank pairing 30 appearing on the second portion 16. More preferably, the top and bottom portions 14, 16 respectively include corner markings or pips to denote the suit-rank paring appearing on the opposite portion 16, 14, such that a player holding a plurality of cards in his hand may be able to determine the suit-rank designations appearing on the bottom portions 16 without having to physically rotate each card 12 or otherwise flip his cards 12 over.

Each series 20, 22, 24, 26 preferably includes a unique pairing of red and black suits. Specifically, the first series 20 is preferably characterized by cards 12 having Spades on the top portions 14 and Diamonds on the bottom portions 16. Likewise, the second series 22 is preferably characterized by cards 12 having Spades on the top portions 14 and Hearts on the bottom portions 16, while the third and fourth series 24, 26 are characterized by cards 12 having Clubs on the top portions 14 and, respectively, Diamonds and Hearts on the bottom portions 16. Also preferably, each series includes cards having the alphanumeric designations Ace, King, Queen, Jack, Ten and Nine adorning both the top and bottom portions 4, 16. (As used herein, the term alphanumeric designation primarily refers to the above-listed word designations and their abbreviations [i.e., A, K, Q, J, 10 and 9] as well as to the commonly used pictorial designations for the King, Queen and Jack). Preferably, each card includes two different alphanumeric designations, such as a first designation on the top portion 14, and a different second designation on the bottom portion 16. More preferably, the highest designation (A) is paired with the lowest designation (9), the second-highest designation (K) is paired with the second-lowest designation (10), and the third- and fourth-highest designations (Q and J) are paired as they appear on the cards 12.

Thus, the twenty-four cards 12 in the deck 10 are designated as follows:

The first series 20 of six cards is marked with the following top and bottom portion 14, 16 designations: Ace of Spades and Nine of Hearts, King of Spades and Ten of Hearts, Queen of Spades and Jack of Hearts, Jack of Spades and Queen of Hearts, Ten of Spades and King of Hearts, Nine of Spades and Ace of Hearts;

the second series 22 of six cards is marked with the following top and bottom portion 14, 16 designations: Ace of Clubs and Nine of Hearts, King of Clubs and Ten of Hearts, Queen of Clubs and Jack of Hearts, Jack of Clubs and Queen of Hearts, Ten of Clubs and King of Hearts, Nine of Clubs and Ace of Hearts;

the third series 24 of six cards is marked with the following top and bottom portion 14, 16 designations: Ace of Spades and Nine of Diamonds, King of Spades and Ten of Diamonds, Queen of Spades and Jack of Diamonds, Jack of Spades and Queen of Diamonds, Ten of Spades and King of Diamonds, Nine of Spades and Ace of Diamonds;

and the fourth series of six cards is marked with the following top and bottom portion 14, 16 designations: Ace of Clubs and Nine of Diamonds, King of Clubs and Ten of Diamonds, Queen of Clubs and Jack of Diamonds, Jack of Clubs and Queen of Diamonds, Ten of Clubs and King of Diamonds, Nine of Clubs and Ace of Diamonds.

METHODS OF PLAY

The above-described deck 10 embodiment of the game system may be used to play a card game involving two teams having two players each. The teams are chosen and the players are preferably seated such that no two team members are seated adjacent each other. A deck 12 is shuffled, and the cards are randomly and evenly distributed (i.e., dealt) to each player. Thus, each player should have six cards 12 in his hand immediately after dealing. Each player reviews his hand and, based on the distribution of cards therein Bidding:

Players sequentially bid based on the number of tricks each respective player believes his hand will enable his team to take during play (as described in detail below). A bid may take the form of a pass, or a bid may be a number selected from the set of integer values from one to six and paired with either a suit (as a potential trump suit designation) or a 'no-trump' designation. Preferably, the no-trump designation may be either high or low no-trump. Bidding continues sequentially until the maximum numerical value of six is bid or until no one raises the numerical value of the bid (i.e., until the bid passes around back to the high bidder). The high bidder names trump for the remainder of the hand based on the content of his high bid.

For example, if the high his bid was Four Spades, for example, then Spades will be considered trump by all players during that hand and the value of the Spades will be trump value. This means the Spades and the two Jacks of Clubs will be trump cards and ranked in the following order; J♠, J♠, J♣, J♣, A♠, A♠, K♠, K♠, Q♠, Q♠, 10♠, 10♠, 9♠, 9♠. This means that there are fourteen cards available to be trump. All of the cards in the other suits will be valued from high to low value; Ace, King, Queen, Jack, (except Clubs because they become Trumps in this particular bid), Ten and Nine, during the play of this hand.

Trump and Card Rank Hierarchy:

During play, the cards are ranked as follows.

Trump suit: a suit that is named in the winning bid and therefore all of the cards of that suit will be of greater value than any card of any other suit during the play of that hand. Trump cards 12 are always higher ranked than non-trump cards 12.

No-trump: all suits are considered equal and the value of a card is simply determined by its number value. No-trump may be played from high cards to low (High no-trump) or in the reverse (low no-trump). The high or low must be named during the bid process prior to play; if not, the default is high no-trump.

If a suit is named trump during play, the cards 12 are ranked in descending order as follows: Jack of the trump suit, Jack of the same colored non-trump suit, Ace, King, Queen, Ten and Nine of the trump suit. For example, if spades were trump, the trump suit would be given as follows (in descending order): J♠, J♣, A♠, K♠, Q♠, 10♠, 9♠. A hand with J♠, J♠, J♣, A♠, K♠, 9♦ would likely deserve a bid of 5 or 6, depending upon the degree of risk the player is comfortable with. For a bid of 6, the player would be gambling that his partner would take at least one trick.

The values in the High No-Trump range in descending value from Ace, King, Queen, Jack, Nine of the same suit and in the reverse order in Low No-Trump. All suits are equal during play in No-Trump. For example, the hand of A♠, A♠, K♠, A♣, K♣ would reasonably support a 4 or 5 bid.

Since there are two faces on each card 12, each suit-rank combination appears twice in the deck. Cards 12 having portions 14, 16 with the same suit and value (i.e., the Ace of Spades) are of equal rank. Thus, the first card 12 played on a trick is valued as the highest and therefore wins the trick even if the same suit-rank combination is later played by another player, wherein a trick is all the cards played in a single round, one from each player. This is a strategic point for a player to keep in mind while trying to formulate his intended bid because there are effectively two of every card in the deck and he may only have one of those.

A player must always follow suit before he can trump, therefore he may be forced to play a card which the top half he had relied upon when making his bid but, later becomes the only card in his hand in which the other end is a match to the suit that has just been led. Since the player must follow suit first during play, he thus loses his higher valued card. The same is true for his partner and opponents; thus, it is important to pay attention to not only the end 14, 16 of the card 12 played in response to the suit led, but also to the other end 16, 14 not currently used in play. This nuance causes the player to continuously revise his strategy as the game is played, Play of the Game:

The player that made the final and highest bid will begin play by leading the first card of the six tricks that are to follow. He places his first card 12 on the table with the end 14, 16 he intends the card 12 to be valued by facing the center. Each player to his left in turn will place a card 12 on the table in the same manner. The players must first follow suit if they can and the first highest ranked card 12 played will win the trick.

If a player cannot follow suit (because he does not have a card with either end 14, 16 displaying the suit that was led), he may then play any card 12 of his choice and that card 12 may be a trump card 12. If a suit was named as trump during the bid, then the highest trump card 12 played first wins the trick. The player that wins the trick wins the right to lead the next trick and may play any card 12 remaining in his hand.

Play follows in this manner until the team that won the bid reaches or exceeds the bid in number of tricks won or does not reach their bid when there are no cards 12 remaining to be played.

Scoring:

If the players that won the bid reach or exceed their bid they get 1 point for each trick taken. If the opposing players win enough tricks that the bidding team cannot attain their bid, then the opposing players get 1 point for every trick they got and the bidding team's score is reduced by the total amount of their original bid. Play continues until one team reaches a predetermined number of points, such as 31 points.

Variations:

In one variation, if a player cannot follow suit (because he does not have a card with either end 14, 16 displaying the suit that was led), he must play trump if trump is present in his hand. If the player has no trump, he may then play any remaining card 12 of his choice.

In another variation, while no points are gained by a team not making their bid, there is likewise no subtractive is no penalty for not making the bid.

In still another variation, if the players that won the bid reach or exceed their bid they get 1 point for each trick taken. The opposing players likewise get one point for every trick taken. If the opposing players win enough tricks that the bidding team cannot attain their bid, then the bidding team's score is reduced by the total amount of their original bid.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A method of playing a game, comprising the steps of:

a) providing a game system including twenty-four bifurcated cards, each respective card having a top portion and an oppositely-disposed bottom portion and wherein the respective cards are characterized by the following respective first and second suit rank pairings on the respective top and bottom portions:

Ace of Spades and Nine of Hearts, King of Spades and Ten of Hearts, Queen of Spades and Jack of Hearts, Jack of Spades and Queen of Hearts, Ten of Spades and King of Hearts, Nine of Spades and Ace of Hearts; Ace of Clubs and Nine of Hearts, King of Clubs and Ten of Hearts, Queen of Clubs and Jack of Hearts, Jack of Clubs and Queen of Hearts, Ten of Clubs and King of Hearts, Nine of Clubs and Ace of Hearts; Ace of Spades and Nine of Diamonds, King of Spades and Ten of Diamonds, Queen of Spades and Jack of Diamonds, Jack of Spades and Queen of Diamonds, Ten of Spades and King of Diamonds, Nine of Spades and Ace of Diamonds; Ace of Clubs and Nine of Diamonds, King of Clubs and Ten of Diamonds, Queen of Clubs and Jack of Diamonds, Jack of Clubs and Queen of Diamonds, Ten of Clubs and King of Diamonds, Nine of Clubs and Ace of Diamonds;

b) forming two two-player teams;

c) distributing six-card hands to each player;

d) sequentially bidding based on the number of tricks each respective player believes his hand will enable his team to take;

e) determining the status of a trump suit from the bidding results;

f) taking tricks;

g) accumulating points; and h) declaring the first team to accumulate a predetermined number of points the winner.

2. The method of claim 1 wherein the predetermined number of points is 31.

3. The method of claim 1 including the steps of:

i) winning the right to declare trump by being the high bidder; and j) receiving points for tricks taken.

4. The method of claim 3 including the step of:

k) subtracting points for declaring trump and taking fewer tricks than the number bid.

5. The method of claim 3 including the step of:

1) accumulating zero points for declaring trump and taking fewer tricks than the number bid.

6. The method of claim 1 wherein the card hierarchy is as follows, from high to low:

Jack of Trump, Left-Jack of Trump, Ace of Trump, King of Trump, Queen of Trump, Ten of Trump, Nine of Trump, Ace of Non-Trump, King of Non-Trump, Queen of Non-Trump, Jack of Non-Trump, Ten of Non-Trump, and Nine of Non-Trump;

wherein the Left-Jack is the Jack of the non-trump suit of the same color as the trump suit; and wherein the hierarch begins with the Ace of Non-Trump if trump suit is determined to be trump.

7. A method of playing a game, comprising the steps of:

aa) providing a game system including twenty-four cards, each respective card having top and bottom portions respectively characterized by the following respective first and second suit-rank pairings:

Ace of Spades and Nine of Hearts, King of Spades and Ten of Hearts, Queen of Spades and Jack of Hearts, Jack of Spades and Queen of Hearts, Ten of Spades and King of Hearts, Nine of Spades and Ace of Hearts; Ace of Clubs and Nine of Hearts, King of Clubs and Ten of Hearts, Queen of Clubs and Jack of Hearts, Jack of Clubs and Queen of Hearts, Ten of Clubs and King of Hearts, Nine of Clubs and Ace of Hearts; Ace of Spades and Nine of Diamonds, King of Spades and Ten of Diamonds, Queen of Spades and Jack of Diamonds, Jack of Spades and Queen of Diamonds, Ten of Spades and King of Diamonds, Nine of Spades and Ace of Diamonds; Ace of Clubs and Nine of Diamonds, King of Clubs and Ten of Diamonds, Queen of Clubs and Jack of Diamonds, Jack of Clubs and Queen of Diamonds, Ten of Clubs and King of Diamonds, Nine of Clubs and Ace of Diamonds;

bb) forming two two-player teams;

cc) distributing the cards to the players;

dd) bidding;

ee) naming a trump suit;

ff) taking tricks;

gg) accumulating points; and hh) declaring the first team to exceed a predetermined number of points the winner.

8. The method of claim 7 wherein the predetermined number of points is 31.

9. The method of claim 7 including the steps of:

ii) winning the right to declare trump by being the high bidder; and jj) receiving points for tricks taken.

10. The method of claim 9 including the step of:

kk) subtracting points for declaring trump and taking fewer tricks than the number bid.

11. The method of claim 9 including the step of:

ll) accumulating zero points for declaring trump and taking fewer tricks than the number bid.

* * * * *